US007665339B2

(12) United States Patent
Valence et al.

(10) Patent No.: US 7,665,339 B2
(45) Date of Patent: Feb. 23, 2010

(54) METHOD FOR INCREASING THE RANGE OF PRODUCTION OF A METAL PRODUCT ROLLING INSTALLATION AND INSTALLATION THEREFOR

(75) Inventors: Marc Valence, Courbevoie (FR); Bernard Rossigneux, Montbrison (FR)

(73) Assignee: VAI Clecim, Saint Chamond (FR)

( * ) Notice: Subject to any disclaimer, the term of this patent is extended or adjusted under 35 U.S.C. 154(b) by 114 days.

(21) Appl. No.: 11/976,696

(22) Filed: Oct. 26, 2007

(65) Prior Publication Data

US 2008/0115551 A1 May 22, 2008

Related U.S. Application Data

(63) Continuation of application No. 10/533,913, filed as application No. PCT/FR03/03290 on Nov. 4, 2003, now Pat. No. 7,481,089.

(30) Foreign Application Priority Data

Nov. 5, 2002 (FR) ..... 02 13843
Jul. 22, 2003 (FR) ..... 03 08954

(51) Int. Cl.
*B21B 13/00* (2006.01)

(52) U.S. Cl. ..... 72/238; 72/243.4; 72/234

(58) Field of Classification Search ..... 72/226, 72/234, 238, 239, 243.4
See application file for complete search history.

(56) References Cited

U.S. PATENT DOCUMENTS

| | | | |
|---|---|---|---|
| 2,039,959 | A | 5/1936 | Iversen |
| 2,601,792 | A | 7/1952 | Dahlstrom |
| 3,913,368 | A | 10/1975 | Eibe |
| 4,197,731 | A | 4/1980 | Verbickas et al. |
| 4,531,394 | A | 7/1985 | Turley et al. |
| 4,658,320 | A | 4/1987 | Hongel |
| 4,763,505 | A | 8/1988 | Klute et al. |
| 4,841,761 | A | 6/1989 | Stoy |
| 4,905,493 | A | 3/1990 | Benedetti |
| 5,133,205 | A | 7/1992 | Rostik et al. |
| 6,098,439 | A | 8/2000 | Lecrivain |
| 7,086,264 | B2 | 8/2006 | Seidel et al. |

FOREIGN PATENT DOCUMENTS

| | | |
|---|---|---|
| EP | 0 555 882 B1 | 8/1993 |
| GB | 665186 A | 1/1952 |
| JP | 61-180601 | 8/1986 |

(Continued)

*Primary Examiner*—Dmitry Suhol
(74) *Attorney, Agent, or Firm*—Laurence A. Greenberg; Werner H. Stemer; Ralph E. Locher

(57) ABSTRACT

The invention relates to a process for increasing the range of production of an installation for cold rolling of metallic strip, consisting of at least two rolling stands (L1, L2) operating in tandem.

According to the invention, at least one (L1) of the rolling stands is equipped with means of converting the stand configuration, while keeping the same means (15, 16, 3, 3') of applying the rolling force, in order to have at least two configurations available, each corresponding to one production range, and the configuration of said convertible stand L1 is selected to match the data of the product (M) to be rolled, thus allowing the production range to be increased.

19 Claims, 8 Drawing Sheets

FOREIGN PATENT DOCUMENTS

| | | | |
|---|---|---|---|
| JP | 62-40907 | A | 2/1987 |
| JP | 62-224410 | A | 10/1987 |
| JP | 63-13603 | | 1/1988 |
| JP | 63-13603 | A | 1/1988 |
| JP | 1-154803 | A | 6/1989 |
| JP | 04-066206 | A | 3/1992 |
| JP | 05-228504 | A | 9/1993 |
| JP | 7-16623 | | 1/1995 |
| WO | 95/24281 | A1 | 9/1995 |
| WO | 02/47837 | A1 | 6/2002 |

METHOD FOR INCREASING THE RANGE OF PRODUCTION OF A METAL PRODUCT ROLLING INSTALLATION AND INSTALLATION THEREFOR

This application is a continuation application of U.S. application Ser. No. 10/533,913, filed May 5, 2005, now U.S. Pat. No. 7,481,089 which in turn is a §371 National Stage of Application No. PCT/FR2003/003290, filed Nov. 4, 2003, which in turn claims priority from French Application Nos. 02/13843, filed Nov. 5, 2002, and 03/08954, filed Jul. 22, 2003, the entire specifications, claims, and drawings of which are incorporated herewith by reference.

The invention relates to a process for increasing the range of production of an installation for cold rolling of strip-shaped metallic material and also covers the installations provided with means of implementing the process for increasing the production range thereof.

Usually, the cold rolling process is carried out in several successive passes, either in two opposite directions on a reversing mill, or on several stands operating in tandem.

It is known that, in a rolling mill, the product is driven between two work rolls the spacing of which is less than the rough thickness of the upstream product. A metal flow occurs, which is friction driven in the roll gap, down to an exit section, the thickness of which substantially corresponds to the gap between work rolls. During this operation the metal structure changes and the material hardness increases.

During the rolling process the work rolls tend to move apart from each other and the gap between opposite generatrices must therefore be maintained by applying a load force between rolls, which is often called the rolling force. The rolling force to be applied for achieving a certain reduction in thickness primarily depends on the work roll diameter, which determines the length of the reduction area, and on the mechanical and metallurgical properties, such as yield strength, metal composition, e.g. ordinary low-alloyed, low-carbon steel, stainless steel, alloyed steel, etc.

As a general rule, a cold tandem mill consists of a number of stands arranged one after the other along the strip travel to ensure the strip thickness is gradually reduced.

Each rolling stand conventionally consists of two housings located at a distance from each other and linked by separators. Arranged between housings is a set of rolls arranged one above the other with parallel axes and substantially in the same roll load plane which is substantially perpendicular to the product travel direction.

Different types of rolling mills can be built. Usually, in a rolling mill, the product to be rolled passes through a pair of work rolls which determine the rolling plane; such rolls have a fairly small diameter relative to the forces to which they are subjected; for this reason, they are supported by at least two back-up rolls between which the rolling force is applied.

It is known that the rolling stands used in the metallurgical industry may feature several types of configuration depending on the type of product to be processed.

The most common rolling mills, especially for high outputs, are four-high mills consisting of two work rolls, each associated with a backup roll of larger diameter, or six-high rolling mills in which intermediate rolls are intercalated between each work roll and the associated back-up roll.

This arrangement makes it possible to use smaller diameter rolls which can be associated with lateral back-up rolls in a so-called "Z-HIGH" configuration.

Other configurations including a varying number of rolls can also be used in the industry, but for lower outputs.

The rolls are supported on each other along basically parallel lines of support and along a generatrix whose profile—normally rectilinear-depends on the forces applied and on the roll strength. Normally, the roll load force is applied by screws or cylinders intercalated between the stand and the shaft ends of one back-up roll, with the other back-up roll being supported through said shaft ends directly on the stand, or through a pass line or height adjustment device designed to compensate for variations in the diameter of all the rolls that wear out gradually. Therefore, the rolls must be able to shift in relation to the stand and, to this effect, are carried by rotational support devices called chocks which are slidably mounted vertically inside windows arranged in both stand housings; each chock is provided with two guiding faces parallel to the roll load plane.

As the back-up rolls have a large diameter, the corresponding guiding faces are directly machined in the two associated housings of the stand. On the other hand, the work rolls of smaller diameter are equipped with smaller chocks and their guiding faces, which are closer to each other, are usually machined in two solid parts attached to the two frames surrounding the window and projecting inward in the latter.

The roll load forces are normally applied between the two ends of the two back-up rolls. As the rolled product of variable width does not fully cover the work roll body length, each roll is allowed to bend under the load applied. This causes the height of the gap between work rolls to vary, this resulting in profile and shape defects.

To try to correct such profile defects across the rolled strip, it has first been proposed to compensate for the roll deformation under the rolling force by a crowning of their surface through machining according to a special profile.

However, thickness deviation on the transverse profile of the rolled product is complex as it is the result of all the deformations sustained by all the rolls having different diameters and of the deformation of all mill stand components under the rolling force.

For this reason, more sophisticated systems have been developed for some years, which allow adjustment of the correction achieved.

In a first known system, controlled bending forces are applied on the two ends of each work roll shaft to produce bending effects allowing the stress distribution to be corrected continuously.

To this effect, hydraulic cylinders arranged on both sides of each chock and resting on the stationary stand in one direction and in the other direction on protruding lateral parts forming the chock back-up lugs are normally used. Usually, said bending cylinders with the associated hydraulic circuits are accommodated inside the two protruding parts used to guide the work roll chocks. These parts thus constitute supporting blocks for the cylinders, often called hydraulic blocks.

A so-called negative bending can thus be achieved by bringing the chocks of the two work rolls closer to each other in order to compensate for an over thickness on product edges or a positive bending by bringing the same chocks of the two work rolls apart from each other to compensate for an over thickness in the product central part.

It has also been proposed, in the so-called "six-high" mills, to intercalate an intermediate roll between each work roll and the associated back-up roll, which allows axial shifting of the two intermediate rolls in opposite directions in order to apply the rolling force not over the full roll barrel length but only across the product width. This reduces the roll deformation and provides better flatness.

A further advantage is that intermediate rolls make it possible to use smaller diameter work rolls and thus to reduce the rolling force required for an equivalent reduction in thickness.

Axial shifting, in opposite directions, of work rolls in a four-high rolling mill and/or of intermediate rolls in six-high rolling mills, can also be effected for better control of stress distribution across the product width.

In addition, in both four-high and six-high mills, particular arrangements of chocks may lead to combine the roll bending system and the roll shifting system.

In another system known as "C.V.C.", the work rolls in a four-high mill and/or the intermediate rolls in a six-high mill are designed with supplementary curved profiles that allow, by axially shifting the rolls, a variable crown to be created between the top roll and the bottom roll.

More recently, it has also been proposed to adjust the rolling force along the generatrix in contact with the work roll or the intermediate roll by transmitting the rolling force through a roll consisting of a sleeve rotating around a stationary shaft and supported on said shaft via a series of cylinders which allow the pressure distribution to be varied along the contact generatrix.

All those devices, including other improvements that have been developed for several years, were instrumental in continuously improving the final product quality in the cold rolling technology, especially on tandem rolling mills. Such devices, however, are costly and therefore cost-efficient only from a given production tonnage. Besides, cost-efficiency should be assured for several years to make the investment financially viable.

However, as the rolling process consists of the metal flowing between the two work rolls, the work roll diameter, the relevant rotational torque and, as a general rule, all the means of applying the rolling force should be adapted to the mechanical, metallurgical and dimensional properties of the product.

It should also be noted that, in a tandem mill, the rolling process determines, by work hardening, a gradual increase in product hardness and, consequently, of the rolling force to be applied for the same reduction of pass from one stand to the next.

As a result, the power capacity of the means of applying the rolling force may reach limitation if the initial product hardness is too high.

Up to now, it thus seemed necessary, in particular for high outputs, to use equipment designed for a definite product range with properties within a fairly limited range. In practice, very high capacity installations, e.g. exceeding 1 million tons a year, have been built only for two steel families: automotive sheet steel and packaging steel.

However, the demand of users is ever changing with a trend toward diversified steel qualities and a sometimes drastic change in the quantities to be supplied. Thus, in the automotive industry, the trend is toward the use of specific steel grades to meet high performance requirements.

For example, for automotive sheet, the so-called CQ, DQ, DDQ, EDDQ steel grades with a yield strength from 150 MPa to 250 MPa and ultra-high carbon, high yield strength steels (HSLA) up to 600 MPa emerged successively. On the other hand, there is a demand for ultralow carbon steels (IF) with 160 Mpa yield strength.

In addition, the objective is to reduce the product weight as far as possible without diminishing the material strength. Consequently, for an equivalent performance, the demand is for sheet products with ever thinner gauges requiring high drafts of thickness, while maintaining the same requirements in terms of thickness regularity, flatness and surface quality.

Besides, even the rolling process must be able to meet the quality requirements of the processed steels.

In fact, "TRIP" (TRansition Induced Plasticity) steels were recently developed, which are produced in such a way that final recrystallization occurs only during the drawing phase while beforehand it occurred in the accelerated cooling phase at exit of the hot strip mill or during cold rolling. Besides, for ordinary or low carbon steel, the breaking point is only slightly higher than the yield strength ($R_e \approx 0.8\ R_m$), while TRIP steel breaking point may be twice as high as the yield strength value. The work hardening curve taken as a basis for determining the pass schedule is, therefore, completely different. Such steels are usually characterized by their breaking point value and not, as mentioned above, by yield strength.

The iron and steel industry has, therefore, to cope with conflicting goals: on the one hand, rolling installations must be equipped with costly devices specially fit to match the required product quality and, on the other hand, the demand from clients is most often not high enough to make such equipment financially viable.

The object of the invention is to resolve all the problems depicted above using a process which makes it possible to expand the production range of a rolling installation that is able to process steels with very diverse dimensional, mechanical and metallurgical properties while maintaining sufficient productivity for all steel grades and yet benefiting from all the necessary means of optimally guaranteeing the required thickness, flatness and surface finish of the rolled product.

The invention also provides a production tool which can easily match the requirements as they emerge, both in terms of product quality and tonnage.

Therefore, the invention is generally applicable to a cold rolling installation for strip-shaped material, at least consisting of two stands operating in tandem for gradually reducing the product thickness, each stand being associated with means of applying a rolling force between two work rolls so that, for a definite stand configuration, a certain reduction ratio is achieved, taking into account the product mechanical and metallurgical properties within a given production range.

According to the invention, at least one of the rolling stands is equipped with means of changing the configuration of the stand, hence convertible, while keeping the same means of applying the rolling force, in order to have at least two configurations each fit for one production range and, for rolling one product, the convertible stand configuration is selected depending on the data of said product so that these data fit within the production range corresponding to the selected configuration.

In particular, the configuration of the convertible stand can be selected in relation to rolled material hardness. Hence, the production range may include products with a breaking point after hot processing ranging from less than 160 MPa to at least 1000 MPa.

In a particularly advantageous embodiment, as each rolling stand is associated with means of controlling at least one of the quality factors such as thickness regularity, flatness and/or surface finish, the configuration of at least one of the rolling stands is changed as a function of the dimensional, mechanical and metallurgical properties of the product to maintain the same quality throughout the overall production range of the installation.

In a first embodiment, to match the specific data of a product to be rolled, the configuration of at least one convertible stand is changed from a four-high arrangement consisting of two work rolls supported on two back-up rolls to a six-high arrangement consisting of two work rolls resting, via intermediate rolls, on the same back-up rolls, and reversely.

In a second embodiment, to match the specific data of a product to be rolled, the configuration of at least one convertible stand is changed from a six-high configuration consisting of two work rolls supported respectively, via one pair of first intermediate rolls, on one pair of back-up rolls, to an "eight-high" configuration consisting of two work rolls supported respectively, via one pair of second intermediate rolls, on the same first intermediate rolls and the same back-up rolls, and reversely.

To further broaden the production range, it is possible to equip at least one convertible stand with removable work roll side back-up means so that, in an additional configuration, very small diameter work rolls can be used.

By selecting the configuration of at least one stand of the rolling mill, the invention allows a minimum thickness reduction of 70% in one pass throughout the expanded production range.

Preferably, the configuration of at least the first rolling mill stand is changed for a six-high configuration for rolling strip with a breaking point equal to or higher than 600 MPa at entry of the mill and for a four-high configuration for rolling strip with a lower breaking point.

However, it may also be advantageous to change the last stand configuration to control the product surface quality at exit of the mill.

Besides, for specific steel grades, it may be more advantageous to change the configuration of at least one of the intermediate stands, especially for conversion to an eight-high configuration with very small diameter work rolls.

The invention also covers a rolling installation for implementing the process, which comprises at least two rolling stands operating in tandem, in which at least one of the stands is equipped with means of quickly replacing one first pair of work rolls by two cassette type assemblies, each consisting of a smaller diameter work roll, associated with an intermediate work roll, the said convertible stand being thus provided with two possible configurations, a first configuration with at least four rolls fit for a first production range, and a second configuration with at least six rolls fit for a second production range, respectively, while maintaining, for both configurations, at least the same back-up rolls and the same means of applying the rolling force.

In a first embodiment, at least one of the stands, in particular the first stand, can be converted from a four-high configuration to a six-high configuration and reversely.

In another embodiment, at least one of the stands, in particular an intermediate stand, can be converted from a six-high to an eight-high configuration, potentially using side back-up means for the work rolls.

In a particularly advantageous embodiment, the stand is equipped with roll bending means which are identical in both configurations and cooperate with back-up lugs of the work roll chocks in a first configuration and with back-up lugs of the intermediate roll chocks in a second configuration and said back-up lugs are arranged substantially at the same level with respect to the rolling plane, on each side thereof.

The invention also covers other advantageous features of the invention which will be mentioned in the following description of some particular embodiments described as an example and illustrated by the accompanying drawings.

FIG. 1 is a schematic view of a four-stand tandem rolling installation in continuous operation, i.e., without strip threading, the rolling mill being fed with butt welded strips. Schematically, such an installation includes, in one strip travel direction, an entry section E, a rolling section L and an exit section S.

Figure 1:
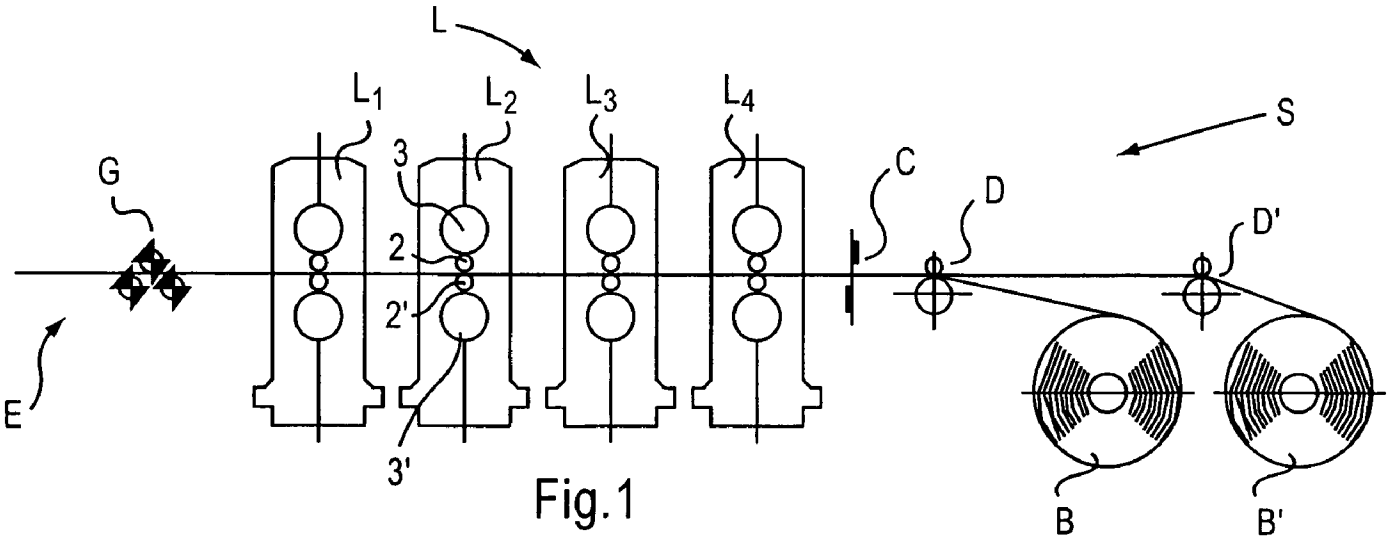
FIG. 1 is a partial schematic elevation front view of an installation as provided by the invention, consisting of four rolling stands in the four-high configuration.

In the illustrated example, the rolling section L includes four stands operating in tandem, i.e. simultaneously achieving a reduction of thickness on the product, and controlled in such a way that a—usually high-tension level, consistent with the material strength, is maintained, allowing, as already known, a higher draft of thickness to be obtained in each stand.

Entry section E includes devices, not shown, for applying tension to the strip, which are located directly upstream of the first stand, and a guiding device G. The exit section S normally includes a dividing shear C for forming coils and, for example, two coilers B, B', each fitted with a guiding and deflecting device D, D'.

It does not seem necessary to further describe such a continuous rolling installation, whose features have been described, for example, in an article called "Le decapage-tandem couple de Sainte Agathe a Sollac Florange" (Sainte Agathe's coupled pickle line/tandem mill) published in "Revue de la Metallurgie", March 1998.

In particular, such an installation may include a varying number of stands operating in tandem and, depending on the type of product and on what it is intended for, various metal strip processing sections arranged in a continuous line or not.

It is commonly known that, in a tandem rolling installation, product thickness is gradually reduced in the successive stands of the mill and the draft percentage that can be achieved in each stand depends on the product mechanical and dimensional data and, obviously, on the means available for applying the rolling force.

Usually, for each product to be rolled, a rolling schedule is established, which determines the percentage of thickness reduction to be achieved in each stand, taking into account that material squeezing determines, through work hardening, an increase in hardness and hence of the rolling force to be applied in the next stands for a given reduction of thickness.

It is known that the achievable thickness reduction percentage depends on a number of rolling parameters.

One essential parameter is, of course, the work roll diameter which determines the metal flow conditions in the roll gap.

Indeed, as the metal is friction-driven along the circular faces of the rolls delimiting the roll gap, a large diameter relative to the thickness reduction to be made will reduce the angle of friction and hence facilitate the strip drive.

For this reason, it seems normal in cold rolling to use work rolls with a fairly large diameter, for example approx. 500 mm.

Besides, a large roll diameter offers additional advantages, for example it provides a wider wearing range and makes the necessary roll cooling more efficient, as it occurs on the periphery.

The smallest diameters—for an equal reduction—allow the necessary rolling force to be reduced, but the wear range is reduced and the roll life shorter, thus increasing the production costs. Besides, as the arc of contact is smaller, it is more difficult to maintain the stand stability, especially on the tandem rolling mills which, as known, permit high tension values to be applied upstream and downstream of each rolling stand.

However, other factors play a role in the rolling process, such as roll lubrication and, on a tandem mill, the tension forces applied on the strip, upstream (Te) and downstream (Ts) of the roll gap.

It has thus been possible to establish that the maximum possible reduction of thickness during a rolling pass can be expressed as:

$$\Big\}_e \leq 2\frac{(\mu + T_e - T_s)^2}{(2F)}D$$

where μ is the friction coefficient, F the rolling force, Te and TS the tension forces at mill stand exit and entry and D the work roll diameter.

To determine a rolling schedule consistent with the grade and size of the material to be rolled, it is therefore necessary, taking into account the available means, to determine such various parameters to be able to roll the product under optimal conditions down to the desired gauge at a normal running speed consistent with the production capacity of the rolling installation.

In this regard, one essential quality required from a rolling installation, is to be able to supply a product with a thickness and surface finish as constant as possible. To this effect, the factors playing a part in the thickness reduction process must be permanently adjusted to ensure that, throughout the production process, the thickness reduction is stable and the flatness and surface finish qualities are constant.

The formula expressed above shows that selecting a large diameter is instrumental in maintaining a constant reduction percentage.

However, a large roll diameter increases the roll gap length and hence the rolling force to be applied.

Besides, to maintain the thickness reduction at a constant level during rolling, it is possible to act upon the rolling force and on the tension forces applied to the product.

As a matter of fact, in a tandem rolling mill, the high tension values obtained between two successive stands allow a higher reduction of thickness. However, the formula mentioned above shows that a fairly high rolling force resulting from a large diameter minimizes the influence of strip tension values. A constant reduction percentage is then ensured by a constant coefficient of friction which is dependent on the quality of roll lubrication and roughness.

Besides, the tension forces that can be applied on the strip, at entry and exit of the installation, are dependent on the devices installed upstream and downstream thereof respectively and are lower than the tension forces generated by a tandem mill stand on the stands that surround the said tandem mill stand.

To increase the rolling force setup range, it might be necessary to reduce the work roll diameter in the first and last stand, taking into account, however, that a fairly large diameter contributes to the product being driven and to the roughness transfer on the last stand, whenever necessary.

Indeed, for a good many high quality products, surface aspect is important and the downstream strip processing operations (galvanizing, painting, etc . . . ) involve accurate and constant surface roughness which is given by the work roll roughness in the last stand of the tandem mill. Now, it is known that the larger the diameter, the easier the roll roughness indentation on the strip. Hence, this is another selection criterion for a large roll diameter, even in the last stand.

Therefore, it appears that the possible actions on the different rolling parameters —some of which influence each other—are rather limited and that is why, up to now, the high capacity tandem rolling installations could be used only for a fairly restricted production range.

For example, for the production of automotive sheets, a hot strip, at least 3 mm thick, is rolled down to an approx. 0.7 to 0.8 mm thick thin strip.

For ordinary automotive sheet qualities, such a reduction rate up to 80% can be obtained on a installation of the type shown in FIG. 1, including 4 or 5 four-high stands with work rolls of a diameter that may range from 530 mm to 620 mm, the actual range of utilization varying between 58 mm to 80 mm, which is cost-saving in terms of roll life.

Normally, the hardness range of the products that can be rolled while maintaining the desired surface quality and a constant thickness reduction is limited to a breaking point which, for instance, may be approx. 600 MPa. Beyond this breaking point, the mechanical roll drive systems, having limited power, become saturated and it is not possible to exert the required rolling force to obtain the desired thickness reduction. As a result, a tandem rolling installation as shown in FIG. 1 can normally be used only for a fairly limited product range for which the technical data of the various devices have been determined and, up to now, it seemed necessary to have installations available, which specialize in rolling the other steel grades, in particular having a breaking point over 600 MPa, such as TRIP steels.

The invention resolves the problem in a simple, fast and cost efficient way by simply changing the configuration of at least one of the mill stands, in order to modify the work roll diameter and thus the range of products that can be treated in the rolling mill.

Equipping at least one of the stands with means of easily changing the configuration, makes it possible, therefore, with the process according to the invention, to considerably expand the production range of a tandem rolling mill.

As an example, the conventional installation schematically shown in FIG. 1, including four mill stands operating in tandem, each equipped with a four-high configuration, is fit for high capacity production of ordinary quality sheet, e.g. for automotive industry, as described above.

Depending on its design and installed power, such an installation has a production capacity ranging from approx.

600 000 ton/y to 2.5 million ton/y; the smaller the range of steel grades to be produced, the higher the production capacity.

Figure 3:
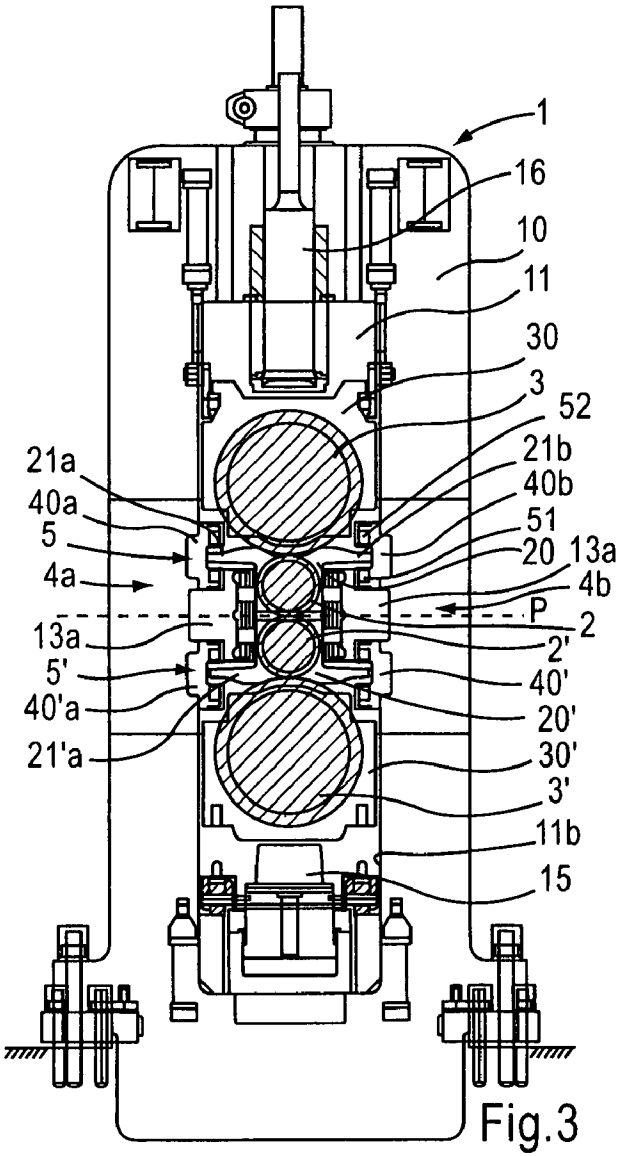
FIG. 3 is a schematic elevation front view of a rolling stand, as provided by the invention, in the four-high configuration.

Each stand L1, L2, L3, L4 is of the four-high type shown in detail in FIG. 3. It includes, inside a stand consisting of two spaced housings 10, one pair of work rolls 2, 2' supported on two back-up rolls 3, 3' and delimiting a gap through which the product M is allowed to travel, in a substantially horizontal rolling plane P in a direction orthogonal to the two work roll axes; the axes of the individual rolls are laying nearly in the same vertical roll load plane $P_1$.

As usual, each roll is mounted rotatable around its axis on antifriction bearings accommodated in chocks slidably mounted, parallel to the roll load plane P, in windows of each stand housing 10.

As shown in FIG. 3, the work rolls 2, 2', which have a smaller diameter than the back-up rolls 3, 3', are supported by two chocks 20, 20' which are allowed to slide vertically along vertical guiding faces 12*a*, 12*b* provided on the 13*a*, 13*b* which are protruding inside the window 11 while the guiding faces for the chocks 30, 30' of the back-up rolls 3, 3' are provided along the vertical sides 11*a*, 11*b* of each stand window 11.

In the bottom part of each stand housing 10 a hydraulic roll force system 15 is incorporated, which, in the particular embodiment of FIG. 3, is equipped with a piston through which the rolling force is applied and allowing gauge control by pushing against the chock 30' of the lower back-up roll 3'. Also accommodated in the top part of each stand housing 10 is a screw type device 16 which keeps the roll stack tight by compensating for height variations due to roll wear. This device 16 may, for example, include one screw operated by a gear reducer and resting on the associated chock 30 of the upper back-up roll 3.

Of course, other e.g. hydraulic devices can be used for pass line adjustment and for gauge control.

It should be noted that, as explained below, the windows 11 and the pass line adjustment and gauge control means 15, 16 are designed to allow the gap between back-up rolls 3, 3' to be adjusted across a wide range.

It is known that each stand of the rolling mill is also equipped with means of controlling the product flatness through work roll bending.

As usual, such bending devices consist, for each chock, of two cylinder assemblies 5, 5' supported, on each side of the window 11, on the two standards of each housing 10, the said standards being provided with guiding faces. Mounted between said guiding faces are two chocks 20, 20' slidably mounted in a direction parallel to the vertical roll load plane P, approximately corresponding to the roll axes.

As depicted above, the said lateral guiding faces 12*a*, 12*b* are provided at the ends of two protruding parts 13*a*, 13*b* which are integral with the two standards of each housing 10 and on which the bending cylinders 4, 4' are normally supported.

In addition, it is known that the bending cylinders must push on the end parts of work rolls or of intermediate rolls in the six-high configuration, either in a positive direction moving away from the rolling plane, in order to compensate for any excessive edge drop, or in a negative direction getting closer to the rolling plane. Therefore, either double-acting cylinders fixed to the chock or to an intermediate part, or two pairs of cylinders pushing in opposite directions on back-up lugs of each chock, on each side of said chock, can be used.

Besides, even in a four-high configuration, it is advantageous that the rolls and associated chocks are also allowed to shift axially. Several arrangements have been proposed for this purpose, but it is advantageous that bending cylinders be shifted with the chocks on which they are supported so that the applied forces are kept centered in relation to the centering bearings mounted in the chock.

Lastly, to change the configuration, i.e., according to the invention, to switch from a four-high to a six-high configuration, it is particularly advantageous to keep the same bending means that remain secured on the mill housings.

The arrangements according to the invention make it possible to resolve these different problems.

Figure 4:
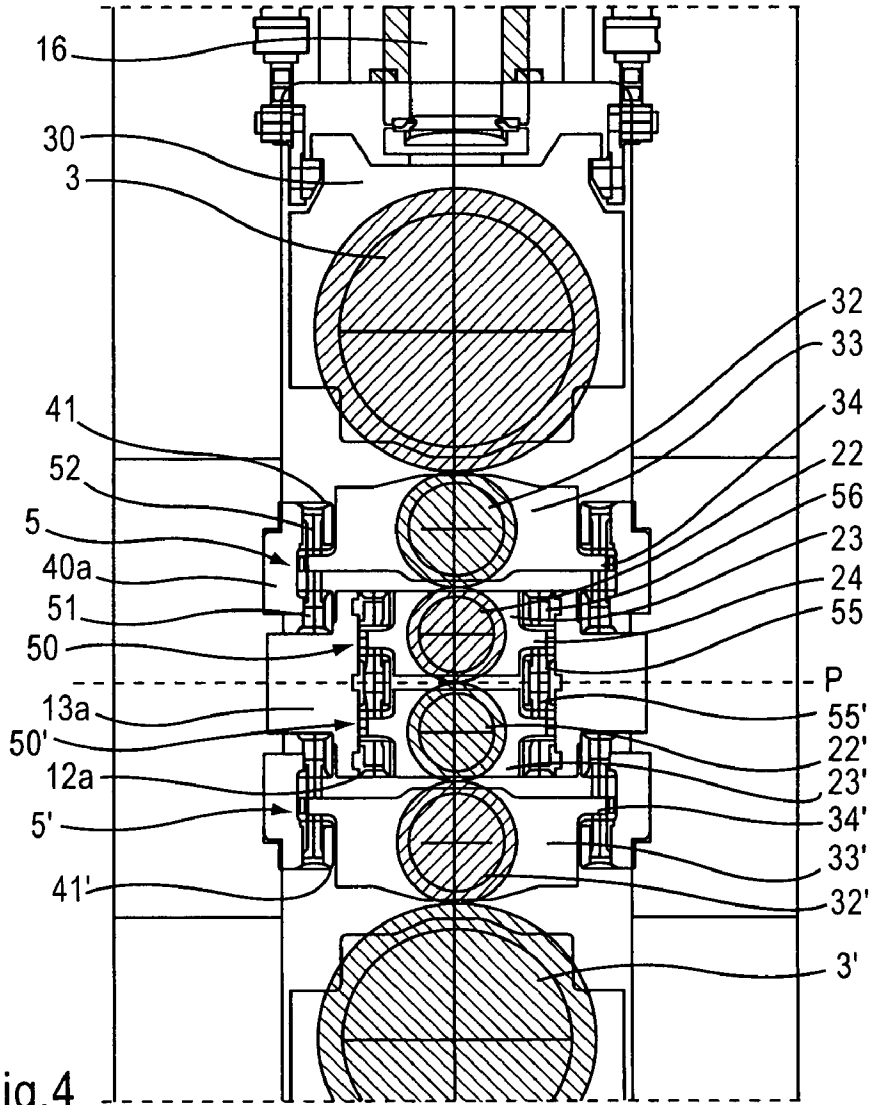
FIG. 4 is a schematic front view on a larger scale basis of the central part of the rolling stand after conversion to the six-high configuration.

FIGS. 3 and 4 show a first embodiment, according to the invention, of a mill stand convertible to a four-high or six-high configuration. As usual, the roll bending cylinders, together with associated hydraulic supply circuits, are accommodated in solid parts 4*a*, 4*b*, called "hydraulic blocks", which are fixed to the two standards of each housing 10 of the stand, in the central part thereof.

Each hydraulic block 4*a*, 4*b* is provided, at the level of the rolling plane P, with a part 13*a*, 13*b* projecting inward the window and carrying, at its inner end, a vertical guiding face 12*a*, 12*b* for the chocks 20, 20' of the work rolls 2, 2', said chocks being fitted with back-up parts 21 called "lugs", which are projecting outward on both sides of the vertical roll load plane $P_1$.

In the embodiment according to FIG. 3 the lugs 21, 21' of the two chocks, upper 20 and lower 20' respectively, are offset, opposite the rolling plane P, with respect to the axis of relevant roll so that said lugs are situated above and beneath the projecting parts 13*a*, 13*b* respectively, in order to cooperate with bending cylinder assemblies, upper 5 and lower 5', respectively.

In the embodiment according to FIG. 3 each assembly 5 includes at least one pair of opposite cylinders 51, 52 arranged on each side of the lug 21 and resting on it, in the positive direction away from rolling plane and in the negative direction closer to the rolling plane, respectively.

Naturally, the arrangement is symmetrical with respect to the rolling plane P and the roll load plane P', as each hydraulic block 4*a*, 4*b* carries two cylinder assemblies, upper 5 and lower 5' respectively.

In addition, to allow the work roll to be shifted axially without off centering the applied forces, the positive 51*a* and negative 52*a* bending cylinders, both located on one side of the roll load plane P, are accommodated in a support part 40*a*, which is slidably mounted, in a direction parallel to the roll axes, on the associated hydraulic block 4*a* in the central part of housing 10 and it is the same on the other side of the roll load plane $P_1$.

Thus, each work roll, for example the upper roll 2, is associated with two support parts 40*a*, 40*b* axially slidably mounted on the two hydraulic blocks 4*a*, 4*b* and supporting the positive bending cylinders 51*a*, 51*b* and the negative bending cylinders 52*a*, 52*b* respectively. In a well-known manner, the two support parts 40*a*, 40*b* are associated with means—not shown—, for example hydraulic cylinders resting on the stand, of operating the axial shifting of the assembly consisting of the work roll 2, its two chocks 20 and the associated support parts 40*a*, 40*b* with the positive 51*a*, 51*b* and negative 52*a*, 52*b* bending cylinders.

Of course, it is the same, on the other side of the rolling plane P, for the lower work roll 2, and its chocks 20', each associated with two support parts 40*a*, 40*b* axially sliding on the hydraulic blocks 4*a*, 4*b*.

FIG. 3 shows that, in the four-high configuration, the protruding parts 13*a*, 13*b* are used only for guiding the chocks 20, 20' of the two rolls, between the opposite ends 12*a*, 12*b* thereof.

However, each protruding part 13 also carries two cylinder assemblies, upper 50, lower 50' respectively, designed for work roll bending in the six-high configuration shown in FIG. 4.

Indeed, in this configuration, the stand consists of the same backup rolls 3, 3' but said rolls have been moved apart so as to replace each work roll 2 of the four-high configuration by a two-roll stack consisting of a new smaller diameter work roll 22 and of an intermediate roll 32.

As mentioned above, the mill windows 11 and the roll load means 15, 16 are designed to provide sufficient adjusting range for the back-up rolls 3, 3'.

As shown in FIG. 4, each chock 23 of a small diameter work roll 22 has the same width as a chock 20 of a work roll 2 in the four-high configuration and is, therefore, vertically guided between the ends 12*a*, 12*b* of the two protruding parts 13*a*, 13*b*. In addition, each chock 23 is provided, substantially at the level of roll 22 axis, with lateral protruding parts 13*a*, 13*b* in the form of lugs engaging in slots machined in the guiding faces 12*a*, 12*b* of the protruding parts 13*a*, 13*b* in order to cooperate with the bending cylinder assemblies 50 accommodated in each protruding part 13*a*, 13*b* and consisting each of one pair of opposite cylinders, positive bending 55 et negative bending 56, respectively.

Besides, in this six-high arrangement, the chocks 33, 33' of the intermediate rolls 32, 32' are allowed to slide vertically on guiding faces 41, 41' parallel to the roll load plane and provided on the opposite faces of the sliding supports 40, 40', each supporting the two sets of bending cylinders, positive 51, 51' and negative 52, 52' respectively, previously described in the four-high configuration shown in FIG. 3.

Therefore, the same cylinder assemblies 5, 5' provided in the four high configuration for bending of work rolls 2, 2' and mounted on the same sliding supports 40, 40' are used for bending the intermediate rolls 32, 32' in the six-high configuration with the same possibility of axial shifting.

According to the invention, the change of configuration can therefore take place by re-using not only the means 15, 16, 3, 3' of applying the rolling force but also the means of adjusting the conditions under which said rolling force is transmitted, such as the means of bending 5, 5' or of axial shifting 40, 40'.

A prerequisite, however, is that the back-up lugs 34 of the chocks 33 of the upper intermediate roll 32 in the six-high configuration be arranged substantially at the same level as the back-up lugs 21 of the chocks 20 of the large diameter upper work roll 2 in the four-high configuration, and it is the same on the other side of the rolling plane for the lower work roll 2 and the intermediate roll 22.

To do this, it is advantageous to use the special chock arrangement shown in FIGS. 3 and 4 in which the lugs 21 of chocks 20 of work roll 2 are offset, in a direction opposite the rolling plane P, with respect to the axis of roll 2 while, for the intermediate roll 32, the lugs 34 of chock 33 are offset toward the rolling plane P with respect to the roll axis, whereby for the lower rolls the arrangement is symmetrical in relation to the rolling plane.

Other arrangements, however, are possible, as explained hereafter.

For example, it is possible to keep the same sliding supports 40, 40' with the same bending cylinder assemblies 5, 5' in both configurations and to simultaneously carry out a positive or negative bending of relevant rolls on the one hand and an axial shifting, in opposite directions, either of the two work rolls 2, 2' in the four-high configuration or of the two intermediate rolls 32, 32' in the six-high configuration, on the other hand.

As the same back-up rolls 3, 3' are used, the means for height adjustment of said rolls must fit in with the space required for the work rolls and intermediate rolls which is larger in the four-high configuration than in the six-high configuration. The piston of the roll force cylinder 15 and the adjusting screws 16 for height adjustment of the upper back-up roll 3 only need to have a sufficient stroke and the window 11 to be dimensioned accordingly.

With these arrangements, it is possible to convert a stand from a four-high to a six-high mode and reversely, using the same back-up rolls 3, 3', the same means 15, 16 of applying the roll load force and the same hydraulic blocks 4*a*, 4*b* with the bending cylinders and the axial roll shifting control means.

As the support parts 40, 40' are the same in the two configurations and are slidably mounted in a direction parallel to roll axes, it is possible to change the mill configuration by means of a roll change device of a well-known type, which makes it possible to extract one work roll assembly by shifting the rolls parallel to roll axes to replace them by other rolls. Indeed, in the arrangement shown in FIG. A, each small diameter work roll 22 associated with an intermediate roll 32 constitutes, together with their chocks, a cassette type unit which can be shifted axially to be removed from or introduced into the stand, said unit being carried by the support parts 40*a*, 40*b* sliding axially. It is thus possible to extract as a complete unit either the two work rolls 2, 2' in the four-high mode or the two upper and lower work roll 22, 22' and intermediate roll assemblies 32, 32' respectively, in the six-high mode.

To this effect, a roll change device of a well-known type, i.e. of the "push-through" type described in the patent EP-0618018 or of the type with a so-called "side-shifter" car as described in U.S. Pat. No. 4,435,970 can be used. Such devices can be used in a rolling mill according to the invention to switch from the "six-high" mode to the "four-high" mode and reversely. Prerequisite is that, in a reserve compartment provided for new rolls, large diameter rolls equipped with specific chocks be installed in advance, intermediate rolls and work rolls used in six-high mode be removed and large diameter rolls alone be introduced, whereby the stand is converted to a four-high configuration. The hydraulic roll force device 15 and the pass line height adjustment system 16 will allow the back-up rolls 3, 3' to be brought into contact with the work rolls 2, 2' requiring less space than the stack of two work rolls of small diameter supplemented by two intermediate rolls 32, 32'.

Reverse operation using the roll change device allows switching from the four-high to the six-high mode.

Thus, while using the same means of applying the rolling force, of controlling thickness and of flatness correction, it is possible to rapidly switch from a "four-high" mode with heavy work rolls to a "six-high" mode with smaller work rolls to cope with the change in hardness of the rolled product.

Figure 2:
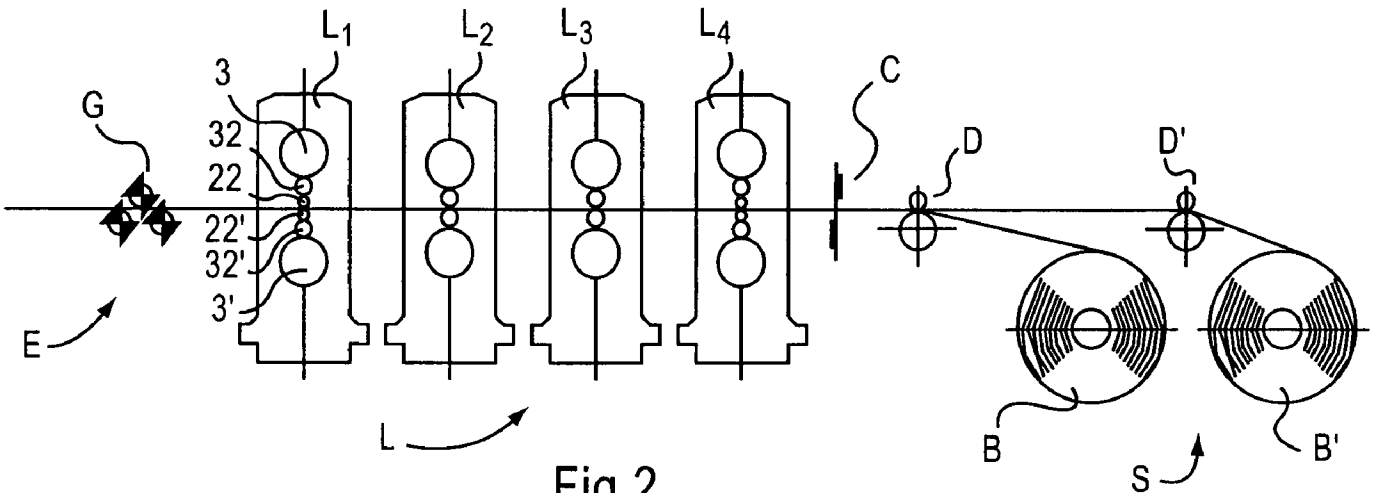
FIG. 2 is a schematic elevation front view of the installation as provided by the invention, after conversion of the first and the last stand.

FIG. 2 shows, as an example, the installation illustrated in FIG. 1 after conversion of the first (L1) and the last (L4) stands to the six-high configuration, the intermediate stands L2, L3 being kept in the four-high configuration.

Such a converted installation is able to process steels in a wider hardness range and, especially, the new grades targeted for autobody sheets with high yield strength and hence high hardness already in the first stand.

According to the invention, this first stand L1 is thus of the convertible type shown in FIG. 3 and FIG. 4 for fast switching from the four-high configuration fit far ordinary steels to a six-high configuration, allowing a high reduction to be achieved already in the first pass and thus drafts of thickness up to 70% to be obtained throughout the tandem mill for this type of steel.

In this six-high configuration, to take into account the height adjustment range for the hydraulic roll force means 15 and pass line adjusting means 16, the work roll diameter can be selected within a range from 360 mm to 485 mm depending on the adopted wear range and on mill width.

In this regard, it should be noted that, for small work roll diameters, the horizontal roll deviation may become significant and be detrimental to the strip flatness and mill stand stability. Such deviation is all the more significant as the work roll bearing points are at a distance from each other, i.e. the rolling mill has a great width. As an example, a wear range of 360 mm to 405 mm for a 66" wide rolling mill and a wear range of 425 mm to 485 mm for a 80" wide rolling mill can be taken as a basis.

Similarly, as per the embodiment shown in FIG. 2, it has been noticed that it would also be of interest to use smaller diameter work rolls in the last stand L4 as the strip material at exit of tandem rolling mill 1 has maximum hardness. It is, therefore, better that the last stand L4 be also convertible so that it can be converted to a six-high configuration for the production of ultra-high yield strength steels, especially "TRIP" steels.

Besides, it is particularly advantageous, in order to keep product quality constant throughout this wider spectrum of grades, that the rolling mill be equipped with the same means of controlling thickness and correcting the shape defects, such as roll bending and axial shifting devices depicted above in the four-high configuration, as described above with reference to FIGS. 3 and 4.

Alterations to the convertible stand needed for changing the configuration are thus fairly limited and the cost of such modifications is greatly compensated by the benefits derived.

As a matter of fact, only changing the configuration of the first mill stand is sufficient to expand the production range and thus to meet any variation in the production schedule without delay.

For example, on the basis of the installation shown in FIG. 1, which is suited for the ordinary steel grades using 530 mm to 620 mm work rolls, it is therefore possible to convert the first stand L1 to a six-high configuration with work rolls of a selected diameter within a range from 360 mm to 485 mm in order to be able, for example, to process high yield strength steels in the first stand L1 where most of the thickness reduction is achieved.

On the other hand, the two intermediate stands L2 and L3 which usually perform a lighter reduction of thickness may be kept in the "four-high" mode with heavy rolls.

However, as product hardness increases from one stand to the next, it may be necessary to also convert the last stand L4 to a "six-high" configuration with small rolls to obtain the desired global reduction.

It should be noted that this conversion of rolling stands is obtained through a quick roll change device which, anyway, is necessary for the replacement of worn rolls.

Therefore, the arrangements according to the invention make it possible to cope with any change in mechanical and dimensional product data with a very high level of flexibility, and thus to considerably expand the production range of the installation.

As the means of applying the rolling force and the means of adjusting the conditions under which said force is transmitted are maintained, the same installation can be very quickly adapted to a change in product data while keeping the same final quality performance on the product, especially thickness regularity, flatness and surface quality.

Normally, one only needs, as explained above, to alter the configuration of the first stand and, potentially, of the last stand to expand the regular production range of a tandem mill, especially to hard steel grades.

However, following the development of the technology, iron and steel makers have to meet the customers' demand for an ever wider spectrum of steel properties.

For example, it may be necessary to produce ultra-high carbon steels with high yield strength variation during work hardening.

In that case, steel hardness increases from one stand to the next and, for ultra-high carbon steels, it may be difficult to achieve the total desired thickness reduction as limits are encountered in intermediate stands.

It is then advantageous, in a more advanced embodiment of the invention, to provide at least one intermediate stand with means of changing the configuration, especially allowing very small diameter rolls, e.g., between 140 and 160 mm to be used.

Such a work roll diameter requires side back-up rolls like in the well-known "Z-HIGH" configuration.

Therefore, in a convertible stand of the type described above and shown in FIGS. 3 and 4, it may be considered to replace each work roll 2, 2' of a fairly large diameter, in the four-high configuration, by a "Z-HIGH" type insert comprising a small diameter roll, an intermediate roll and side back-up rollers.

In such an arrangement, the insert frame can be provided with side back-up parts arranged substantially at the same level as the backup lugs of work roll 2, 2' chocks so that they can fit in with the same bending devices that, in the "Z-HIGH" configuration, push on the intermediate rolls.

In that case, however, a roll axial shifting system is not available in the "Z-HIGH" configuration. Besides, with small diameter rolls, it is necessary to motorize the intermediate rolls which, in a six-high configuration, rotate in a direction opposite the work roll rotational direction. Therefore, the drive motors with associated power supply and control must be able to run in both rotational directions at full speed and power in order to drive the work rolls in the four-high configuration or the intermediate rolls in the six-high configuration.

Besides, quite often, the user may prefer to have an equipment with a basic six-high configuration for all applications, as each stand can be equipped with work rolls with a large diameter range.

Figure 5:
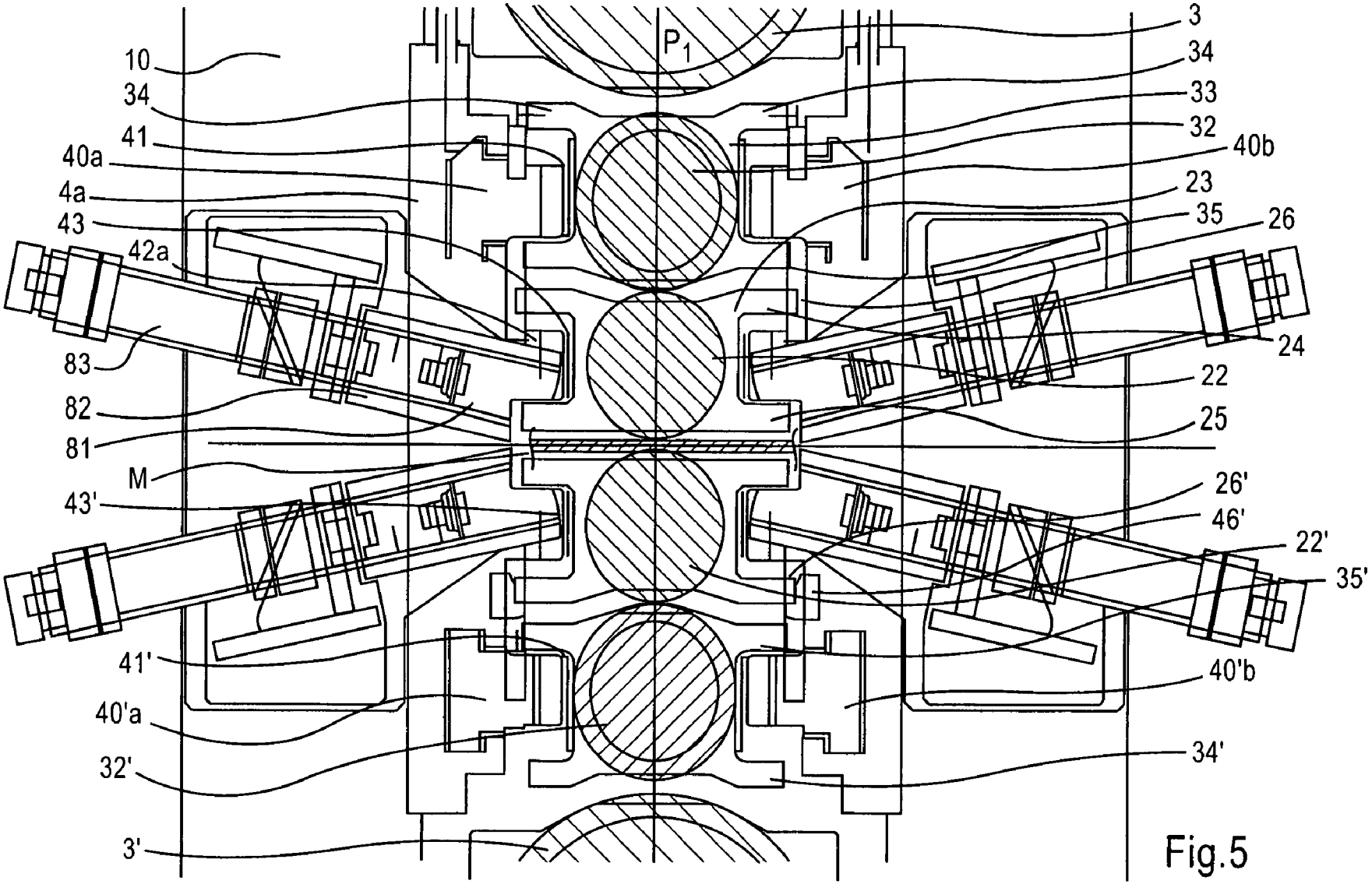
FIG. 5 is an elevation front view of a further embodiment of a convertible stand in a six-high configuration.
Figure 6:
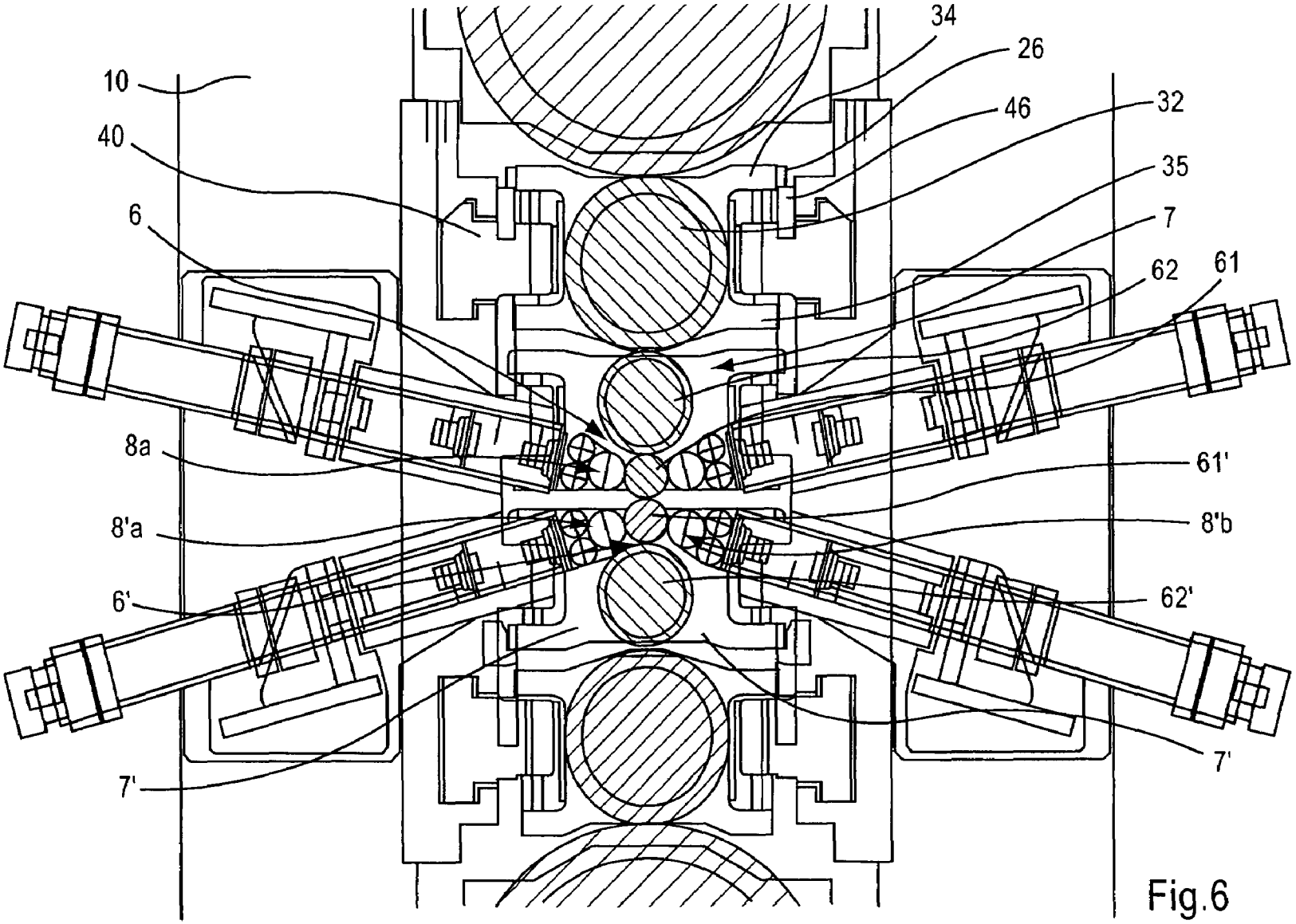
FIG. 6 is an elevation front view of the central part of the FIG. 5 rolling stand after conversion into an eight-high stand with side back-up means.

To solve such problems, in another embodiment, the rolling mill comprises at least one convertible stand of the type shown in FIG. 5 thru 12 that can have rolls of quite large diameter in a six-high configuration (FIG. 5) and very small diameter rolls with side back-up rolls, in an eight-high configuration (FIG. 6).

FIG. 5 shows an elevation front view of the central part of said convertible stand, in the six-high configuration. As shown in FIG. 4, the stand includes six rolls stacked on each side of the rolling plane P, two work rolls 22, 22', two intermediate rolls 32, 32' and two back-up rolls 3, 3', respectively.

Figure 7:
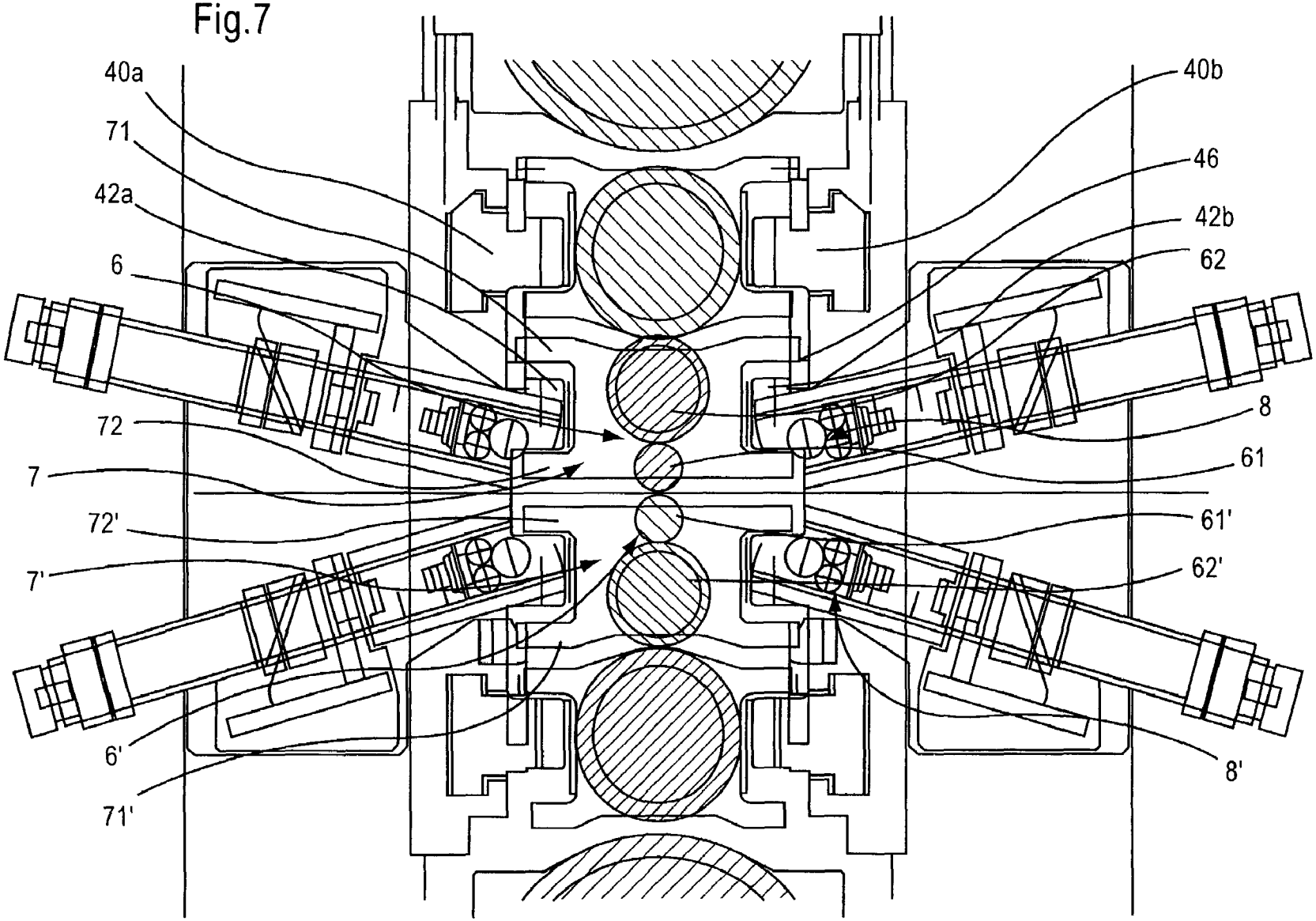
FIG. 7 shows the eight-high stand of FIG. 6 in the cassette change position.

Concerning the roll bending device and the roll chocks, FIG. 5 to 7 show an alternative embodiment, in which each chock, on each side of the roll load plane, is provided with back-up lugs spaced apart on each side of the horizontal plane passing through the roll axis and, respectively above and beneath a protruding part integral with the mill housing and in which the bending cylinders are arranged.

Each chock 23 of a work roll 22 is thus fitted, on each side of the roll load plane $P_1$, with two lugs 24, 25 arranged above and beneath a part 42 fixed to the hydraulic block 4 and projecting inward the window up to a vertical face 43 for lateral guiding of the chock 23. Each protruding part 42 carries at least one pair of cylinders, not shown, acting in opposite directions, on an upper lug 24 of chock 23 for positive bending of roll 22 and on a lower lug 25 for negative bending, respectively.

Consequently, while in the arrangement according to FIGS. 3 and 4 the two work roll chucks 20, 21 are guided, on each side, by the same protruding part 13*a*, 13*b* centered on rolling plane P, in the alternate arrangement according to FIGS. 5 and 6, the work roll chocks 23, 23' are guided sideways by two separate parts 42, 42' disposed on each side of the rolling plane P. On the other hand, like in the preceding arrangement, the chocks 33, 33' of the intermediate rolls 32, 32' are slidably mounted between vertical guiding faces 41, 41' provided at the ends of two support parts 40, 40' which are also slidably mounted on hydraulic blocks 4*a*, 4*b* in a direction parallel to roll axes.

However, the positive and negative bending cylinders for chocks 23, 23' are mounted on the second protruding parts 42, 42' and not on the sliding parts 40, 40', as is the case in FIGS. 3 and 4.

With the arrangement shown in FIG. 5 a work roll 22 of fairly large diameter can be replaced by a cassette type assembly 6 consisting of a small diameter work roll 61 associated with an intermediate roll 62. The sum of the diameters of the two rolls 61, 62 is approximately equal to the diameter of work roll 22 in the six-high configuration shown in FIG. 5 so that the intermediate rolls 32, 32' are kept nearly at the same level.

Besides, as shown in FIG. 7, the two rolls 61, 62 of each cassette 6 are mounted rotatable, at their end parts, on two frames 7 having a shape similar to the shape of chocks 23 of work rolls 22 in the six-high configuration, said frames, therefore, comprising back-up lugs 71, 72 with a vertical distance between said lugs equaling the distance between lugs 24, 25 of a work roll chock 23 and situated respectively above and beneath the protruding parts 42*a*, 42*b*, the end parts 43 of which constitute the vertical guiding faces of the chock-shaped frame 7.

It is thus possible to change the mill configuration, by replacing each work roll 22 of the six-high configuration by a cassette 6, for a so called eight-high configuration using the same back-up rolls 3, 3' and the same first intermediate rolls 32, 32' and comprising, on each side of the rolling plane P, a small diameter work roll 61, 61' associated with a second intermediate roll 62, 62'.

As the frame 7 of each cassette 6 of an eight-high configuration has the same shape as the chocks 23 of the work roll 22 of the six-high configuration, it is possible to use a quick change system by roll shifting parallel to the roll axes, whereby the chocks 23 or frames 7 are resting, through roller bearings 26, 73, on rails 46 mounted on the protruding parts 42*a*, 42*b*.

As shown in FIG. 5, above the rolling plane, the roller bearings 26 are mounted on the upper lugs 24 of the upper chock 22 or 71 of the frame 7 of the eight-high insert. Below the rolling plane P, roller bearings 26, 73' are fixed to the lower lugs 24' of the chocks 22' or 71' of the frames 7'.

The protruding parts 42, 42' support bending cylinder assemblies which are kept in position during the change of configuration and act positively or negatively either upon the work rolls 22, 22' in the six-high configuration, or on the second intermediate rolls 62, 62' in the eight-high configuration.

Figure 10:
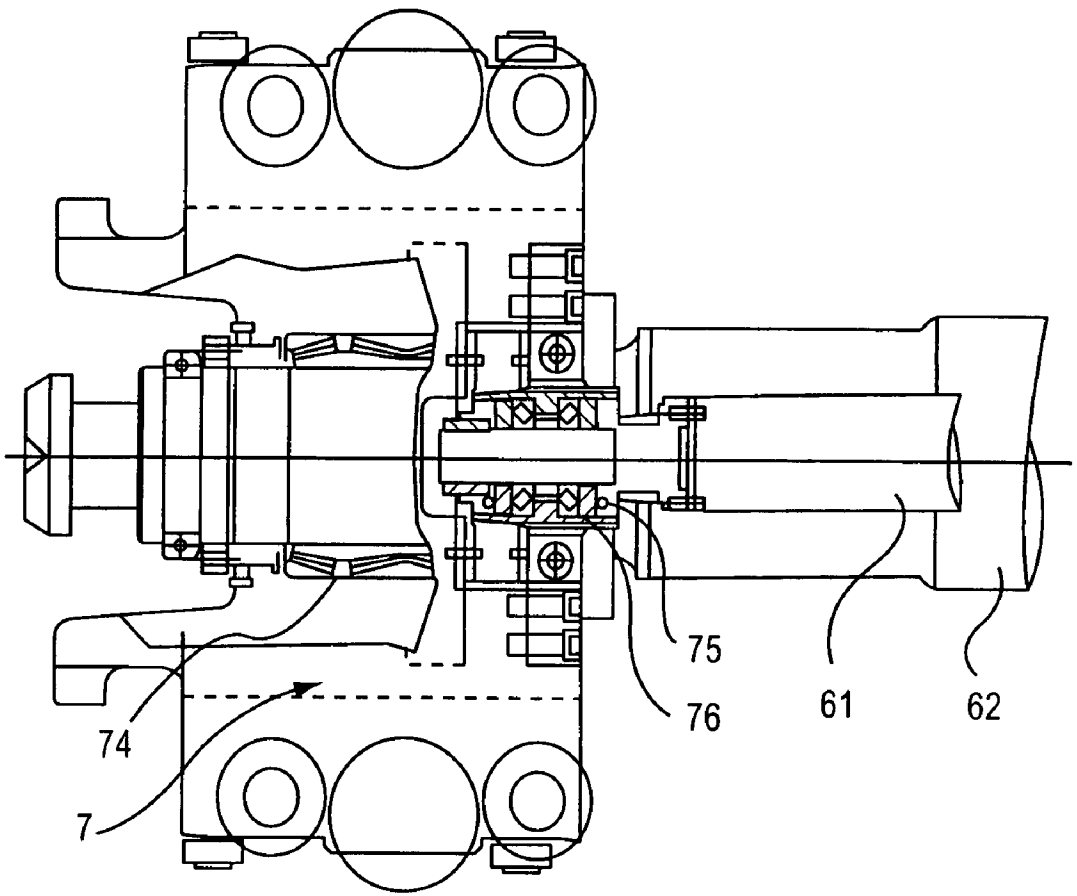
FIG. 10 is a top view with a broken-out section of the end part of a cassette for the eight-high configuration shown in FIG. 8.
Figure 11:
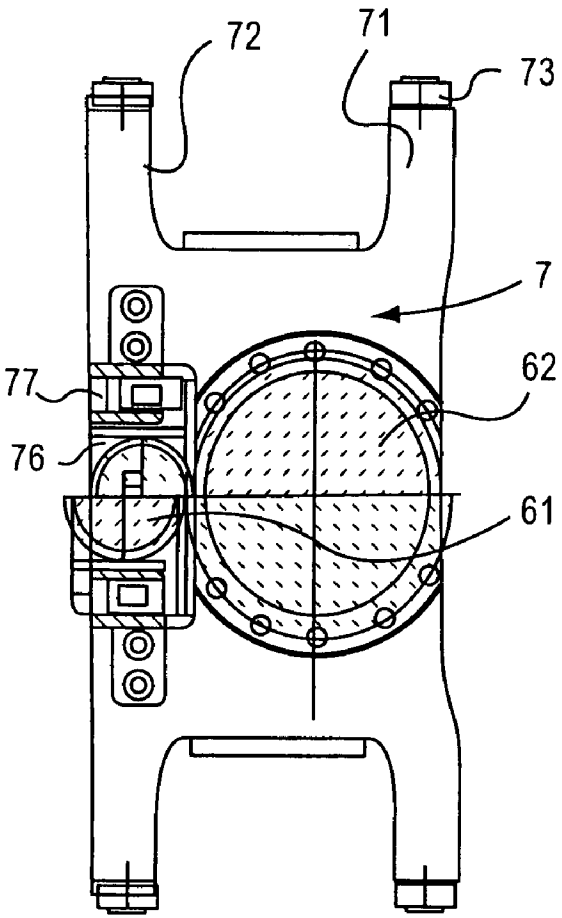
FIG. 11 is a sectional view along the line I, I of FIG. 9.

FIGS. 10 and 11 show details of the frame arrangement of an eight high insert consisting of a small diameter work roll 61 and a second intermediate roll 62.

Each second intermediate roll 62 is fitted, at each end, with a neck supported by a bearing 74 having an outer cage fixed to the frame 7 which thus plays the role of a chock for the roll 62.

On the other hand, the associated work roll 61 is simply rotatably mounted, at each end, on an axial thrust bearing 75, said bearing being, however, mounted, with a transverse clearance possibility, in a holding device 76 secured on the inner face of the frame 7 and comprising a spring-type device 77 which permanently presses the work roll 61 on the intermediate roll 62 in order to compensate for any roll diameter variation due to wear, as shown in FIG. 11.

As can be seen, with the arrangements described above, it is possible to keep, in both six-high and eight-high configurations, the same bending means accommodated in the protruding parts 42, 42' and the same first intermediate rolls 32, the axial position of which is adjustable in both configurations by means of support parts 40, 40'.

Besides, in the eight-high configuration, the first intermediate rolls rotate in the same direction as the small diameter work rolls. Therefore, it is not necessary to use motors with two directions of rotation, as the drive torque can be applied, through spindles, either on the work rolls of fairly small diameter in the six-high configuration or on the first intermediate rolls in the eight-high configuration.

Therefore, the arrangements according to the invention provide the possibility of rapidly converting a six-high configuration equipped with work rolls having a large diameter range e.g. 495 to 515 mm, into an eight-high configuration with small diameter rolls, e.g. in the range of 140/160 mm associated with intermediate rolls 62 in the 330/355 MEI/NA range.

However, there is a risk of deflection during rolling of such work rolls as small in diameter and said rolls should preferably be associated with side support rollers according to an X arrangement shown, as an example, in FIG. 6.

Each small diameter work roll, upper 61 and lower 61' respectively, is therefore held sideways by two roll assemblies 8*a*, 8*b*, each mounted on a support frame 81, which is allowed to slide, along a direction inclined relative to the rolling plane P, on guides 82 fixed to the corresponding standard of the mill housing, whereby the sliding of said support 81 is operated by a cylinder 83.

Preferably, each roll assembly 8 can easily be removed with its support frame 81 in order to free the room in the centre of the stand in the six-high configuration shown in FIG. 5. Only the four slideways 82 and cylinders 83 remain fixed to the stand housings 10.

Consequently, to switch from the six-high configuration in FIG. 5 to the eight-high configuration in FIG. 6, the only thing to do is to re-install the frames 8 supporting the back-up rollers 8 on the slideways 82 and to fix them on the cylinder rods, as shown in FIG. 6.

Figure 8:
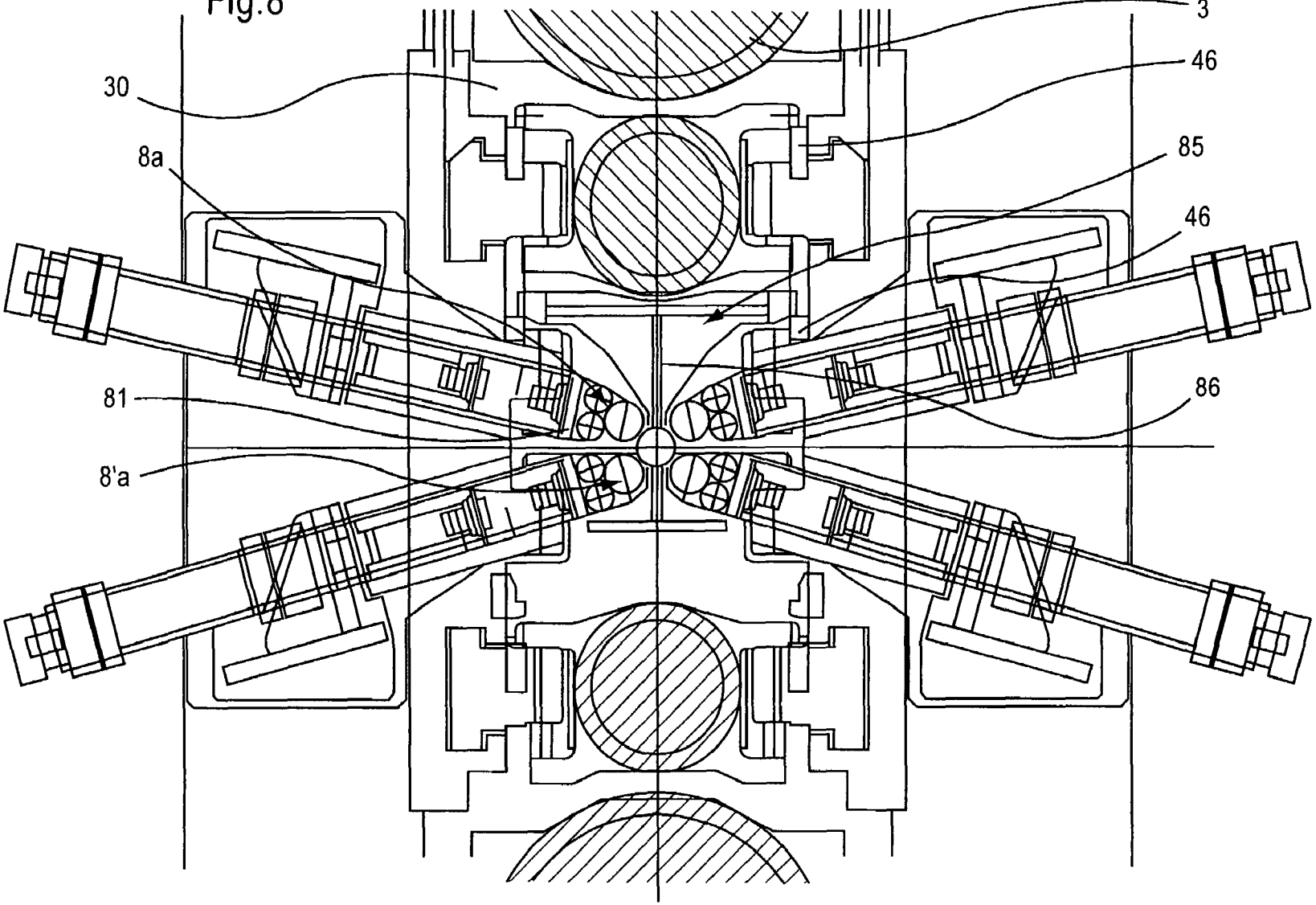
FIG. 8 shows the eight-high stand of FIG. 6 in the side back-up change position.
Figure 9:
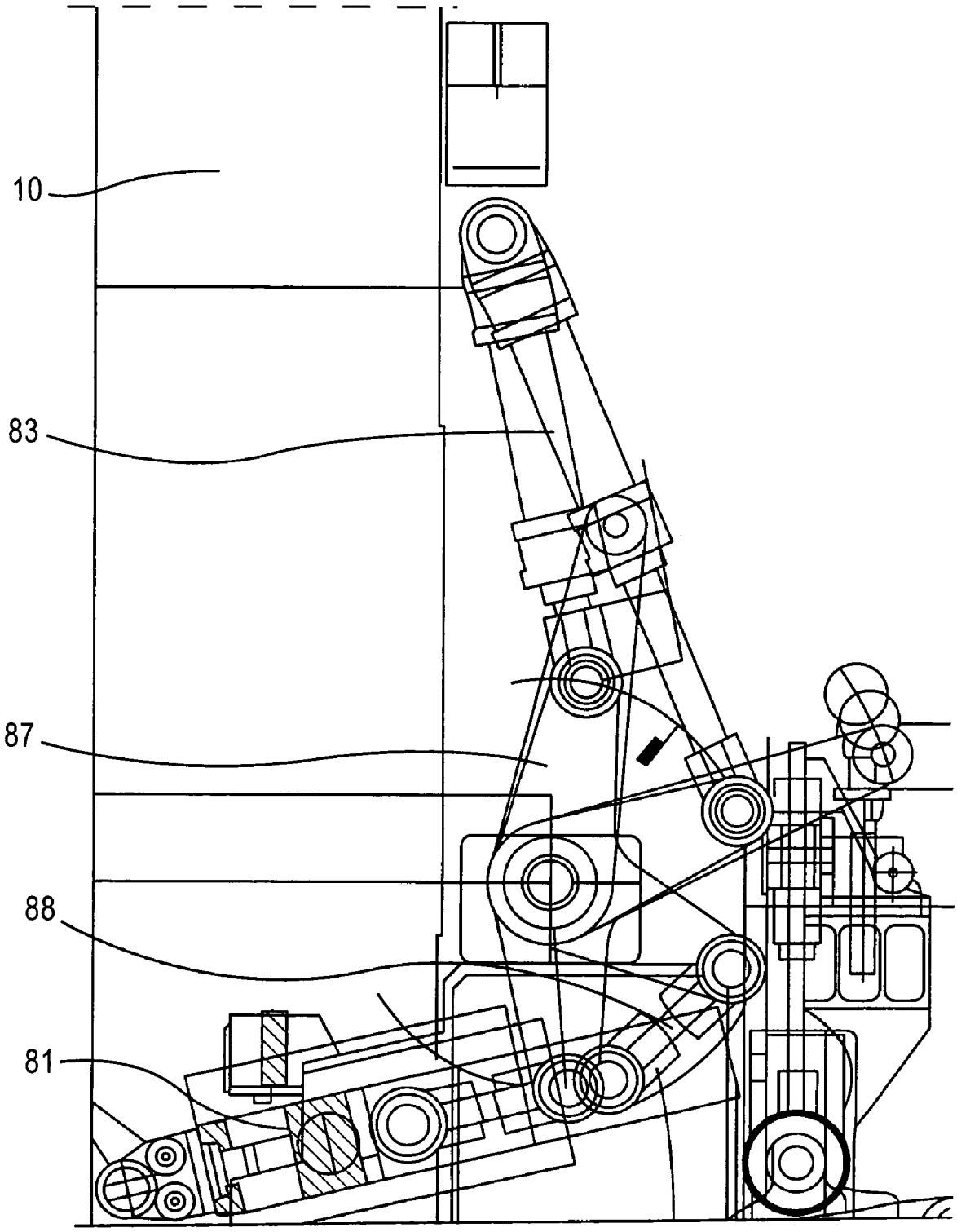
FIG. 9 is a partial elevation front view showing an alternative embodiment of the side back-up device.

The removal of the four roller assemblies 8 may take place in the manner shown in FIGS. 7 and 8.

If an eight-high configuration has to be converted to a six-high configuration, the roller assemblies 8 are retracted inside the slides 82 so as to free the whole central area of the mill, as shown in FIG. 7. It is then possible to remove from the stand the inserts 6 together with the support frames 7 and replace them by the two large diameter work rolls 22, 22' supported by their chocks 23, 23' traveling on rails 46, 46' so as to restore the six-high configuration shown in FIG. 5.

One or several lateral back-up assemblies 8, 8' can also be easily removed from the stand for maintenance or replacement. To this effect, after removal of work rolls or inserts, a roll change support 85 is introduced into the central area of the stand, said support 85 resting, via roller bearings, on the upper rails 46 and carrying two orthogonal walls shaped as a cross 86 which limits four quadrants into which the four roller assemblies 8 can be introduced, pushed by the cylinders 83. The roller support frames 81 are then disconnected from the cylinders and the roll change support 85 can be removed from the stand by axial shifting, thereby carrying away the four roller assemblies 8, 8'.

As explained above, it is particularly advantageous to provide the intermediate stands of a tandem mill with such an arrangement that allows quick conversion from a six-high configuration to an eight-high configuration with small diameter work rolls, whenever the production range of the rolling mill must be extended to ultra-high carbon steels having a yield strength significantly varying during work hardening. Switching to the eight-high arrangement with small rolls prevents any power limitation usually occurring when such steel grades are rolled in a tandem mill.

Of course, the present invention is not limited to the details of the embodiments depicted above; alternate solutions may be conceived without departing from the scope of protection of the invention.

In particular, it is only by way of an example that two types of chocks are shown on the Figures, as the invention may be applied to other bending types or means which can be kept in position in all configurations provided the lugs of the work roll or intermediate roll chocks are arranged substantially at the same level.

Besides, should it be more advisable, in case of axial roll shifting, to shift the bending means at the same time, said bending means could also be accommodated in the stationary parts of hydraulic blocks. Pressure values in the individual rolls are then adjusted depending on the chock mid-plane position relative to the stand housings.

Similarly, the roll axial shifting device could be used in association with work rolls of 'CVC' type curved profile to obtain a crown variation, or it could be used, as already known, with work rolls having one part of their body machined for edge drop control on the rolled strip.

Within the scope of the invention, it is also possible to use a backup roll with a deformable sleeve of the type described, for example, in the document EP-A-0248738, to increase the flatness control capabilities of the convertible stand, in particular by equipping the last stand L4 of the tandem mill.

Besides, when using very small diameter rolls associated with lateral back-up means, as shown in FIGS. 5 and 6, it might be preferable to move the cylinders, through which the side back-up means can slide, away from the rolling plane. To this effect, it could be advantageous to use the arrangement shown in FIG. 9, in which each cylinder 83 causing a roller assembly 8 to slide, is hinged to the housing 10 around an axis at a distance from the rolling plane and causes a crank-shaped lever 87 to rotate, said lever being tied to the frame 81 supporting the back-up rollers 8 through a connecting rod 88 having its ends articulated.

Moreover, the tandem mill to which the invention is applied may be of any known type and could include a varying number of stands.

Besides, the invention has been described in its application to the production of automotive sheet but it can be applied to any other type of product for which it is interesting to increase the production range of an installation, e.g. aluminum.

The reference figures inserted after the technical data mentioned in the claims are only aimed to facilitate the understanding of such claims and are under no circumstances meant to restrict the scope thereof.

What is claimed is:

1. Method for increasing the range of production of an installation for cold rolling of a strip-shaped product having an ultimate tensile stress ranging from less than 160 MPa to at least 1000 MPa, said method comprising operating at least two rolling stands in tandem for gradually reducing the thickness of product, each stand being associated with means for applying a rolling force between two work rolls, allowing, for a given stand configuration, a certain percentage of thickness reduction to be achieved, taking into account the dimensional, mechanical and metallurgical properties of the product, whereby said properties are related to a given production range, equipping at least one of the stands with means for converting the configuration of the stand, hence convertible, while keeping the same means for applying the rolling force, in order to have at least three configurations each suited for one production range, including respectively a six-high arrangement comprising two work rolls two first intermediate rolls and two back-up rolls and an eight-high arrangement comprising two work rolls supported respectively, via a pair of second intermediate rolls, on the same first intermediate rolls and the same back-up rolls, and reversely and, for rolling a product, selecting the configuration of at least one of the stands of the rolling mill depending on the mechanical and metallurgical properties of the product.

2. Method as claimed in claim 1 for increasing the production range of a rolling installation, comprising said at least two rolling stands, each associated with means of controlling at least one of the quality factors such as thickness regularity, flatness and/or surface roughness, characterized in changing the configuration of at least one of the rolling stands depending on the dimensional, mechanical and metallurgical properties of product to maintain the same quality throughout the global production range of the installation.

3. Method as claimed in claim 1, characterized in that said at least one convertible stand is equipped with removable work roll lateral back-up means so that, in an additional configuration, very small diameter work rolls that may be associated with lateral back-up means can be used.

4. Method as claimed in claim 1, characterized in changing the configuration of at least the first stand of the tandem rolling mill in the strip travel direction.

5. Method as claimed in claim 1, characterized in changing the configuration of the first and of the last stand of the rolling mill.

6. Method as claimed in claim 1, characterized in operating at least three rolling stands in tandem, and in changing the configuration of at least one intermediate stand of the tandem mill.

7. Method as claimed in claim 6, characterized in changing the configuration of said at least one intermediate stand of the tandem mill while keeping the configuration of the first and of the last stand of the rolling mill.

8. Method as claimed in claim 1, characterized in selecting the configuration of at least one of the stands of the rolling mill depending on the mechanical and metallurgical properties of the product to allow a minimum thickness reduction of 70% in one pass throughout the global production range.

9. Cold rolling installation, comprising means for allowing a product to run through a rolling plane, successively in at least two rolling stands operating in a tandem rolling mill, each stand comprising two housings, at least six stacked rolls including a pair of back-up rolls, a pair of first intermediate rolls and a pair of work rolls, each of said rolls being rotatably mounted on two chocks, means for applying a rolling force between said rolls with adjustment of respective gaps, and means for adjusting the conditions under which the rolling force is transmitted, comprising at least roll bending means, wherein at least one convertible stand of the tandem rolling mill is provided with at least two possible configurations, while maintaining, for both configurations, at least the same back-up rolls and the same means for applying the rolling force, including respectively a six-high configuration comprising two work rolls supported respectively, via said pair of first intermediate rolls, on said pair of back-up rolls, and an eight-high configuration comprising two small diameter work rolls supported respectively, via a pair of second intermediate rolls, on the same first intermediate rolls and the same back-up rolls, wherein the chocks of said first intermediate rolls are slidably mounted, in a direction parallel to a roll load plane, between guiding faces provided at the end of first protruding support parts mounted on the stand housings, and wherein the chocks of the work-rolls in the six-high configuration and of the second intermediate rolls in the eight-high configuration are slidably mounted between guiding faces provided at the end of second protruding support parts mounted on the stand housings and cooperating with bending means carried by said second protruding support parts.

10. Installation as claimed in claim 9, characterized in that at least one convertible stand is equipped with removable work roll lateral back-up means so that, in an additional configuration, very small diameter work rolls, associated with said lateral back-up means, can be used.

11. Installation as claimed in claim 9, in which the roll chocks are slidably mounted between guiding faces provided at the ends of support parts supporting the bending means, characterized in that each chock is fitted with two pairs of back-up lugs spaced apart situated above and beneath the support parts, respectively.

12. Installation as claimed in claim 9, characterized in that the first support parts carrying bending means of the first intermediate rolls of the six-high and eight-high configurations are slidably mounted, in a direction parallel to roll axes and in opposite directions, above and beneath the rolling plane respectively, in order to adjust the roll gap to the product width in each configuration.

13. Installation as claimed in claim 9, characterized in that at least one convertible stand is equipped, in a six-high configuration, with one pair of back-up rolls, one pair of first intermediate rolls and one pair of work rolls and, in an eight-high configuration, the same back-up rolls and the same first intermediate rolls, between which two cassette-type assemblies are intercalated, each comprising one small diameter work roll associated with one second intermediate roll.

14. Installation as claimed in claim 13, characterized in that the convertible stand is equipped with lateral back-up means mounted on housings of stand and shiftable between two positions, a distant position for the six-high configuration and an engaged position for lateral back-up of each small diameter work roll, in the eight-high configuration.

15. Installation as claimed in claim 13, characterized in that each cassette-type assembly of the eight-high configuration comprises one second intermediate roll having two necks, each supported by a holding frame in the form of a chock supporting a bearing and a small diameter work roll having two centering necks, each supported by an axial thrust bearing accommodated in a box connected to the frame holding the second intermediate roll through spring-type means for pressing the work roll on the said second intermediate roll.

16. Installation as claimed in claim 13, characterized in that each cassette-type assembly of the eight-high configuration comprises one second intermediate roll having two necks, each supported by a holding frame in the form of a chock supporting a bearing and a small diameter work roll having two centering necks, each supported by an axial thrust bearing accommodated in a box connected to the frame holding the second intermediate roll through spring-type means for pressing the work roll on the said second intermediate roll.

17. Installation as claimed in claim 13, characterized in that the rolls of each cassette-type assembly are mounted rotatable, at their ends, on two holding frames having a shape similar to the shape of the chocks of the work rolls in the six-high configuration.

18. Installation as claimed in claim 17, characterized in that the chocks of the work rolls in the six-high configuration and the holding frames in the eight-high configuration are each fitted with two pairs of back-up lugs spaced apart and situated above and beneath the second protruding support parts which carry bending means being kept in position during the change of configuration and acting positively or negatively either upon the work rolls in the six-high configuration or on the second intermediate rolls in the eight-high configuration.

19. Installation as claimed in claim 14, characterized in that said lateral back-up means are provided according to an X-arrangement, each small diameter work roll being held sideways by two roll assemblies each mounted on a support frame sliding along a direction inclined relative to the rolling plane on guides fixed to the corresponding standard of the mill housings.

* * * * *